US010274202B2

(12) United States Patent
Cadima

(10) Patent No.: US 10,274,202 B2
(45) Date of Patent: Apr. 30, 2019

(54) GAS BURNER ASSEMBLY FOR AN APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 207 days.

(21) Appl. No.: 15/490,942

(22) Filed: Apr. 19, 2017

(65) Prior Publication Data

US 2018/0306448 A1 Oct. 25, 2018

(51) Int. Cl.

| | |
|---|---|
| ***F24C 3/02*** | (2006.01) |
| ***F24C 15/04*** | (2006.01) |
| *F24C 3/08* | (2006.01) |

(52) U.S. Cl.

CPC ..... *F24C 3/022* (2013.01); *F24C 15/04* (2013.01)

(58) Field of Classification Search

CPC ..... F24C 15/04; F24C 3/02
USPC ..... 126/39 E, 39 H–39 K, 214 R
See application file for complete search history.

(56) References Cited

U.S. PATENT DOCUMENTS

| | | | | |
|---|---|---|---|---|
| 7,527,495 | B2 * | 5/2009 | Yam | F23D 14/06 126/40 |
| 8,011,358 | B2 * | 9/2011 | Galindo | F23D 14/58 126/39 E |
| 8,899,972 | B2 * | 12/2014 | Fowler | F23D 14/06 126/39 E |
| 8,932,049 | B2 * | 1/2015 | Ryu | F23D 14/06 126/39 E |
| 8,973,569 | B2 * | 3/2015 | Padgett | F23D 14/06 126/39 E |
| 8,978,637 | B2 * | 3/2015 | Ryu | F23D 14/06 126/39 K |
| 9,022,780 | B2 | 5/2015 | Padgett | |
| 9,557,063 | B2 * | 1/2017 | Cadima | F24C 3/126 |
| 2011/0186037 | A1 | 8/2011 | Ryu et al. | |
| 2016/0025348 | A1 | 1/2016 | Cadima | |
| 2016/0033139 | A1 * | 2/2016 | Cadima | F23D 14/06 126/39 E |
| 2016/0102866 | A1 | 4/2016 | Cadima | |

* cited by examiner

*Primary Examiner* — Gregory L Huson
*Assistant Examiner* — Nikhil P Mashruwala
(74) *Attorney, Agent, or Firm* — Dority & Manning, P.A.

(57) ABSTRACT

A gas burner assembly for an appliance includes a circular inner wall that defines a plurality of inner flame ports. An elongated outer wall extends around the circular inner wall such that the elongated outer wall is spaced from the circular inner wall. The elongated outer wall defines a plurality of outer flame ports. A cap is positioned on the circular inner wall over the plurality of inner flame ports and on the elongated outer wall over the plurality of outer flame ports.

16 Claims, 7 Drawing Sheets

GAS BURNER ASSEMBLY FOR AN APPLIANCE

FIELD OF THE INVENTION

The present subject matter relates generally to gas burners for appliances, such as cooktop appliance.

BACKGROUND OF THE INVENTION

Range appliances generally include a cooktop portion and an oven portion. The cooktop portion of certain range appliances includes a griddle burner for heating large cookware, such as griddles and fish poachers. Griddle burners provide flame ports along a length of the griddle burner in order to heat large cookware on the cooktop portion.

A drawback of griddle burners is that griddle burners consume space on the cooktop portion that could be used for a more common round gas burner. To address this drawback, some griddle burners have partitioned sections, such as the burner in U.S. Pat. No. 7,527,495, that allow one section to be used for heating smaller cookware. However, partitioned griddle burners are difficult to control and are frequently too hot to properly heat a griddle. Another solution is to provide a round burner at a center of the griddle burner, such as in the burner of U.S. Patent Application No. 2011/0186037. The round burner allows better heating of round cookware. However, evenly heating a griddle with the round burner and griddle burner employed simultaneously can be difficult. In addition, cleaning the round burner and the griddle burner can be difficult, and providing sufficient secondary air to the round burner through griddle burner can also be difficult.

Accordingly, a burner assembly with features for assisting with heating a griddle and cookware smaller than a griddle would be useful. In particular, a burner assembly with features for assisting with uniformly heating a griddle and uniformly heating cookware smaller than a griddle that is also easy to clean and provides sufficient secondary air would be useful.

BRIEF DESCRIPTION OF THE INVENTION

The present subject matter provides a gas burner assembly for an appliance. The gas burner assembly includes a circular inner wall that defines a plurality of inner flame ports. An elongated outer wall extends around the circular inner wall such that the elongated outer wall is spaced from the circular inner wall. The elongated outer wall defines a plurality of outer flame ports. A cap is positioned on the circular inner wall over the plurality of inner flame ports and on the elongated outer wall over the plurality of outer flame ports. Additional aspects and advantages of the invention will be set forth in part in the following description, or may be apparent from the description, or may be learned through practice of the invention.

In a first exemplary embodiment, a gas burner assembly for an appliance includes a circular inner wall that defines a plurality of inner flame ports. An elongated outer wall extends around the circular inner wall such that the elongated outer wall is spaced from the circular inner wall. The elongated outer wall defines a plurality of outer flame ports. A cap is positioned on the circular inner wall over the plurality of inner flame ports and on the elongated outer wall over the plurality of outer flame ports.

In a second exemplary embodiment, an appliance includes a top panel. A gas burner assembly is positioned at the top panel. The gas burner assembly includes a circular inner wall that defines a plurality of inner flame ports. An elongated outer wall extends around the circular inner wall such that the elongated outer wall is spaced from the circular inner wall. The elongated outer wall defines a plurality of outer flame ports. A cap is positioned on the circular inner wall over the plurality of inner flame ports and on the elongated outer wall over the plurality of outer flame ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
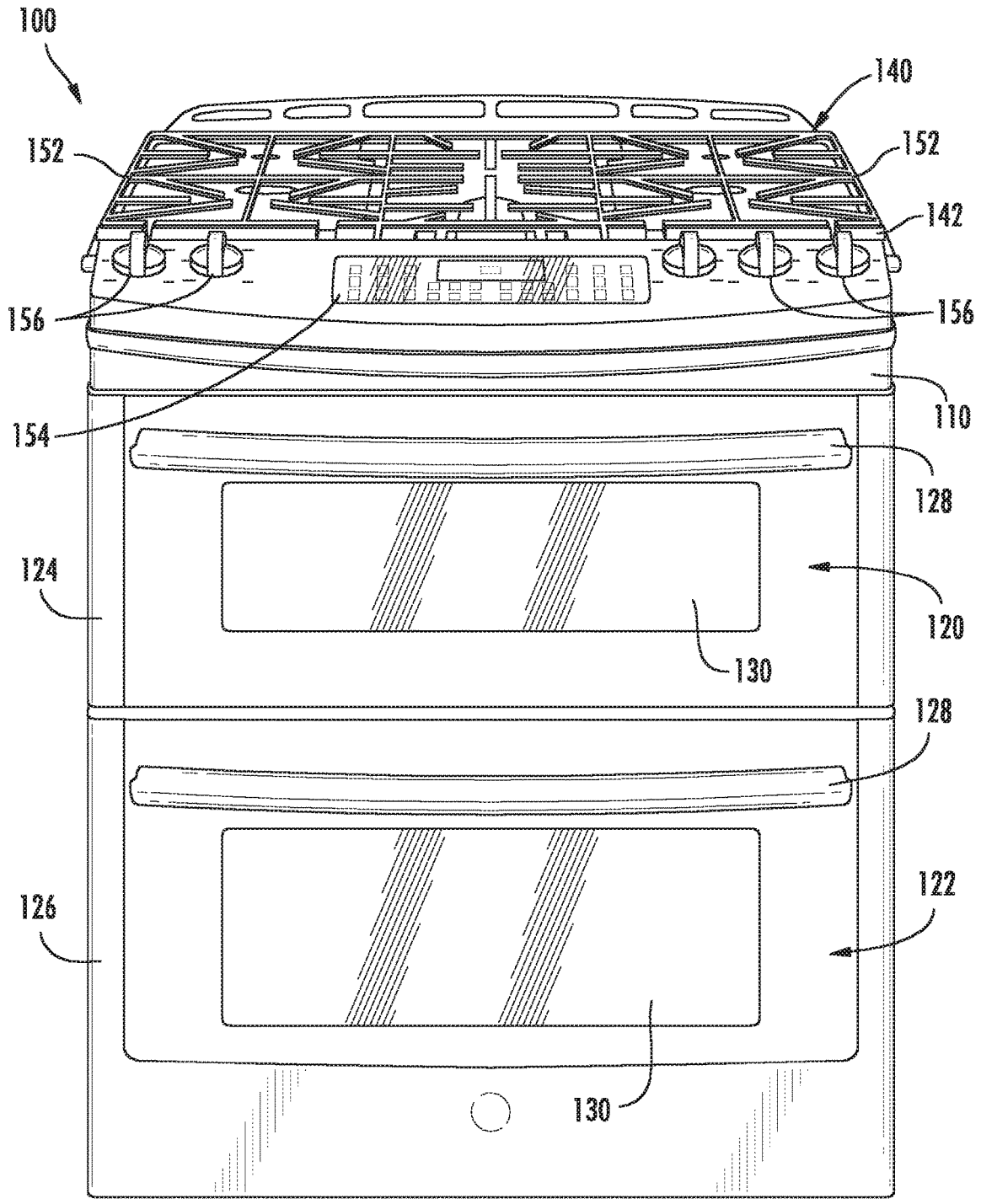
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
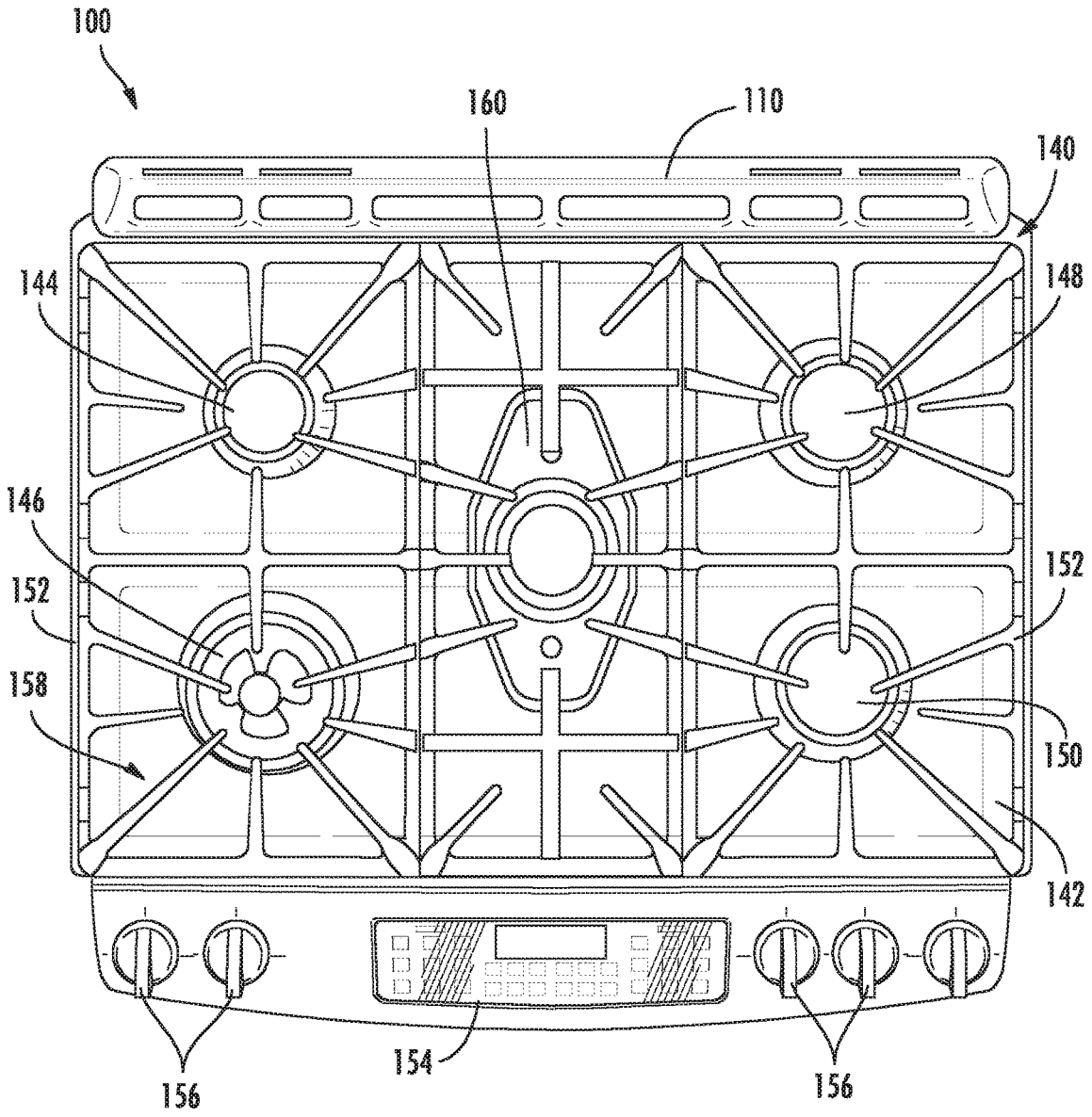
FIG. 2 provides a top, plan view of the exemplary range appliance of FIG. 1 and a burner assembly of the exemplary range appliance.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable cooking appliance, e.g., a single oven range appliance or built-in cooktop. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the level at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
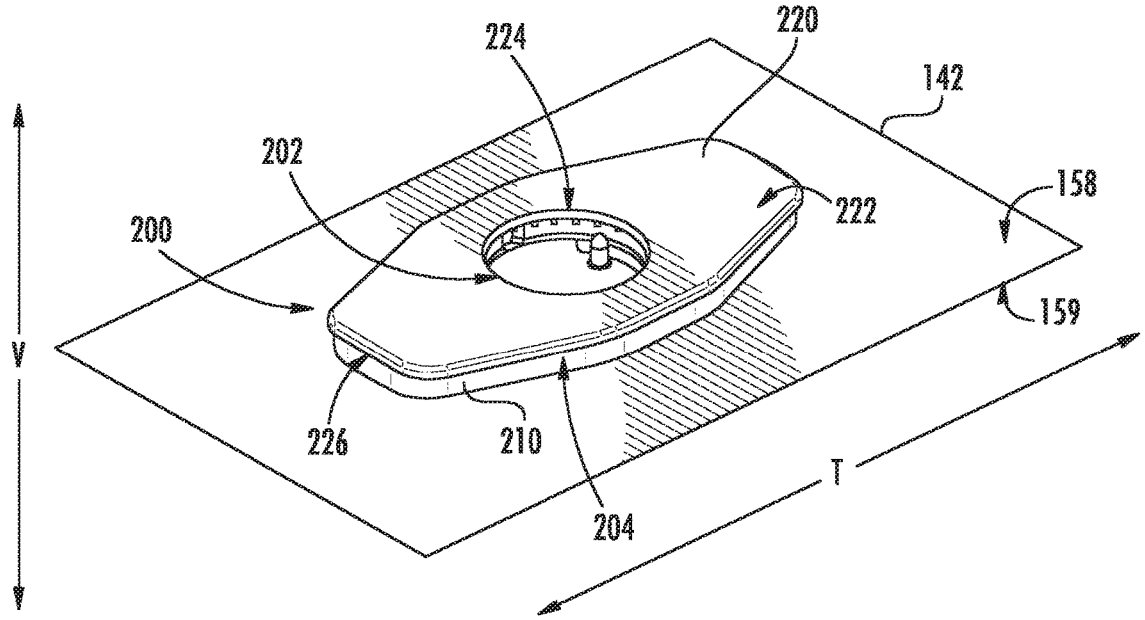
FIG. 3 provides a perspective view of an elongated burner assembly according to an exemplary embodiment of the present subject matter.
Figure 4:
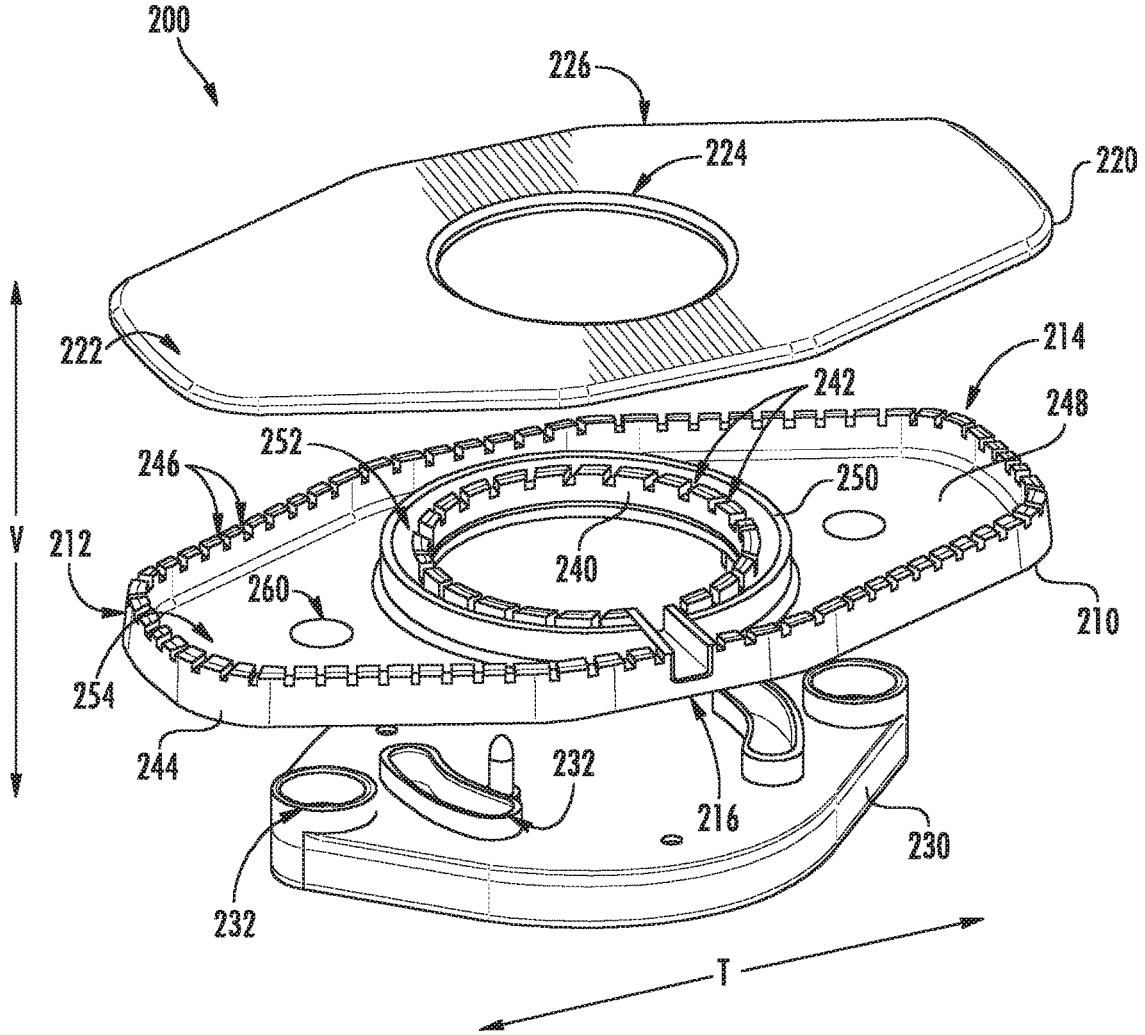
FIG. 4 provides an exploded view of the exemplary elongated burner assembly of FIG. 3.
Figure 5:
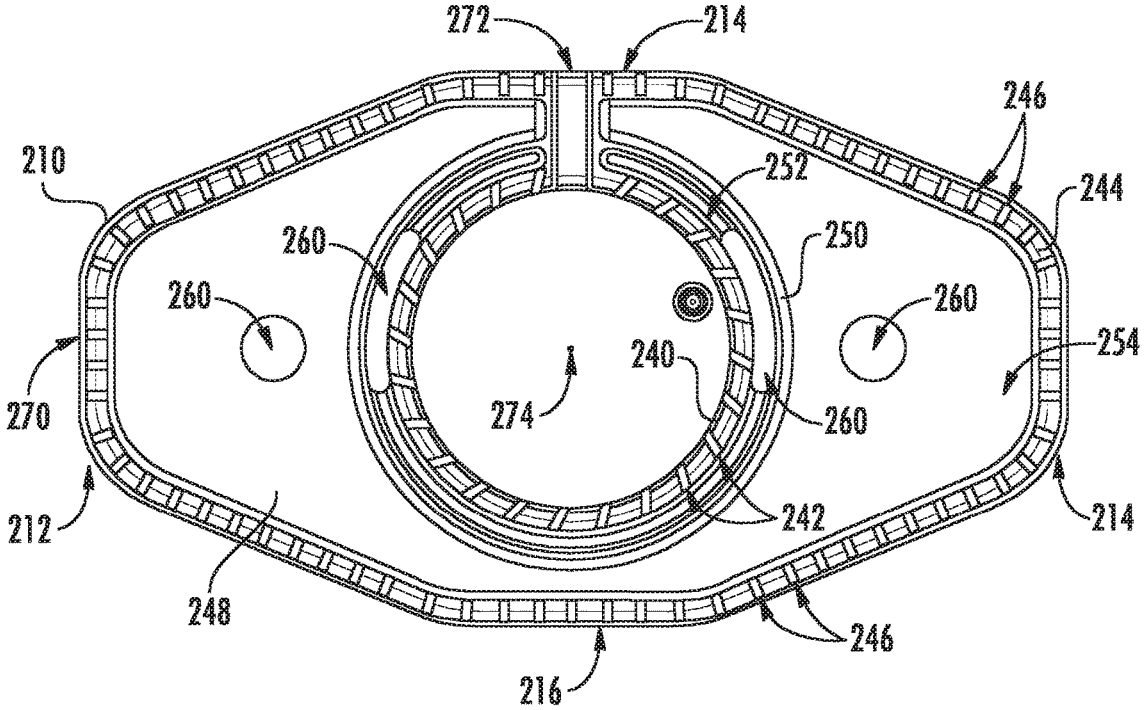
FIG. 5 provides a top, plan view of a burner base of the exemplary elongated burner assembly of FIG. 3.
Figure 6:
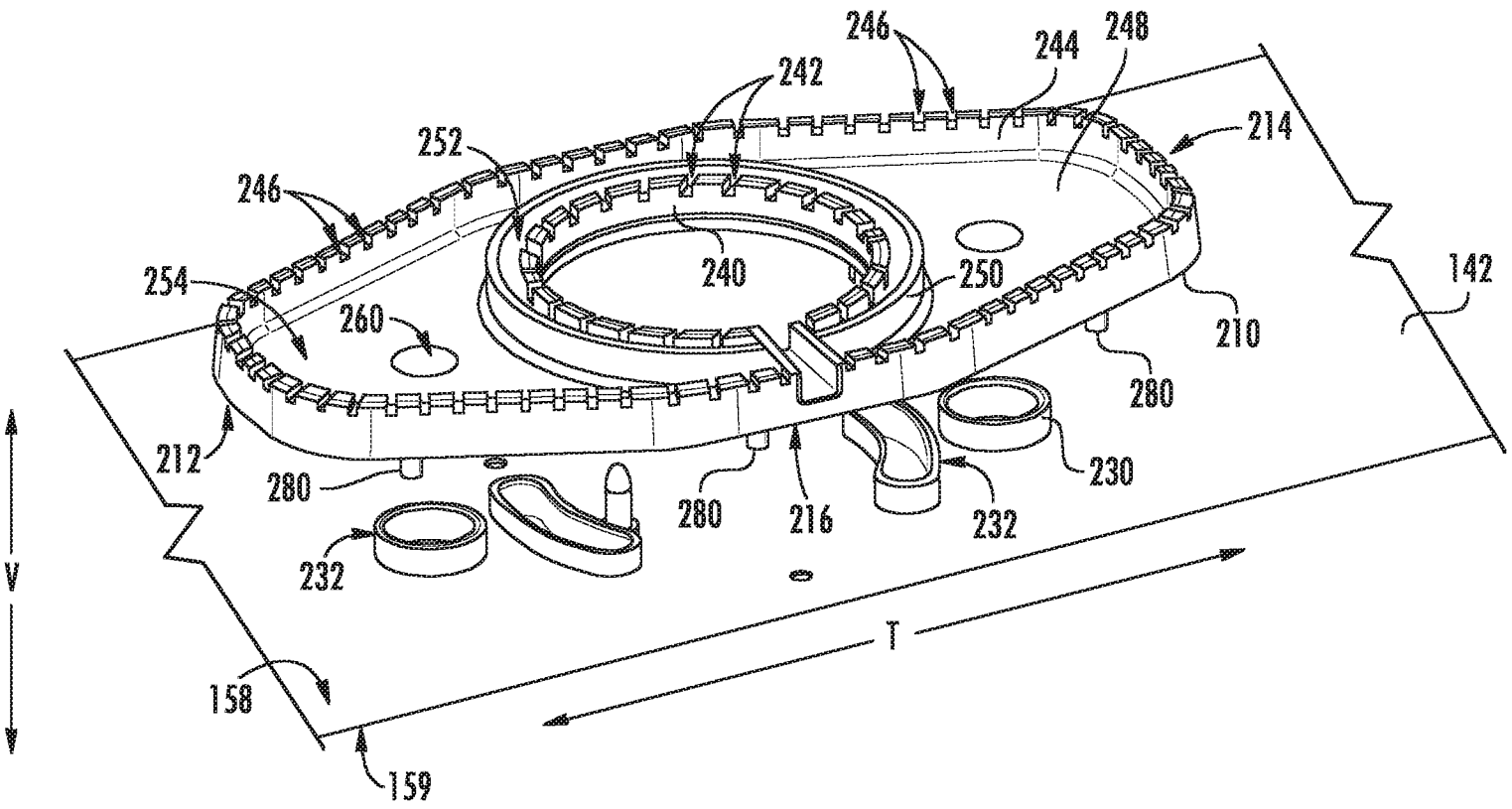
FIG. 6 provides another exploded view of the exemplary elongated burner assembly of FIG. 3.
Figure 10:
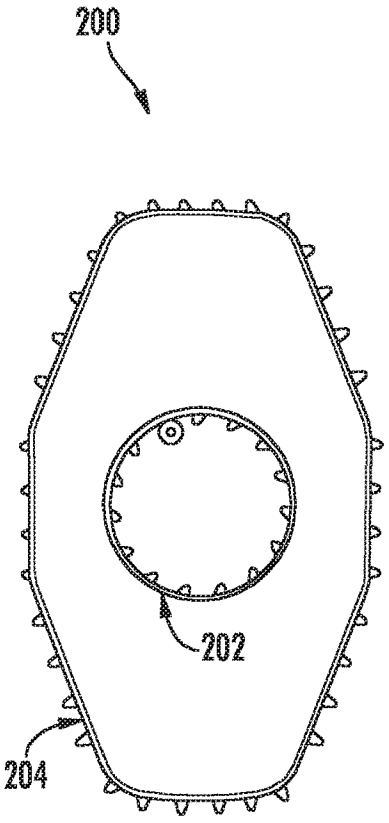
FIGS. 7, 8, 9 and 10 provide top plan views of the exemplary elongated burner assembly of FIG. 3 in various operating conditions.

FIG. 3 provides a perspective view of an elongated burner assembly 200 according to an exemplary embodiment of the present subject matter. FIG. 4 provides an exploded view of burner assembly 200. FIG. 5 provides a top, plan view of a burner base 210 of burner assembly 200, and FIG. 6 provides another exploded view of burner assembly 200. Burner assembly 200 may be used in any suitable appliance. For example, burner assembly 200 may be used in range appliance 100 (FIG. 2) as griddle burner 160. Burner assembly 200 includes features for assisting with heating large cookware, such as griddles or fish poachers. During operation of burner assembly 200, a user may heat a griddle or fish poacher with burner assembly 200 to assist the user with heating large cookware uniformly and/or evenly. Burner assembly 200 is discussed in greater detail below.

As may be seen in FIGS. 3, 4 and 6, burner assembly 200 includes a burner base 210, a cap or cover plate 220 and a fuel manifold 230. As shown in FIG. 3, burner base 210 may be positioned on top panel 142, e.g., top surface 158 of top panel 142, and cap 220 may be positioned on burner base 210. Burner base 210 may be positioned on top panel 142 such that burner base 210 is easily removable from top panel 142. For example, burner base 210 may rest on top panel 142 such that burner base 210 is not fastened or otherwise coupled to top panel 142, and a user may remove burner base 210 from top panel 142 by simply lifting burner base 210 upwardly along the vertical direction V away from top panel 142. In such a manner, a user may easily clean top panel 142 below burner base 210. As shown in FIG. 6, fuel manifold 230 may be mounted to top panel 142 such that fuel manifold 230 is positioned opposite burner base 210 about top panel 142 along the vertical direction V. Thus, fuel manifold 230 may be mounted to top panel 142 at a bottom surface 159 of top panel 142.

Turning now to FIGS. 4 and 5, burner base 210 includes a circular inner wall 240 and an elongated outer wall 244. Inner wall 240 defines a plurality of inner flame ports 242. Thus, inner wall 240 and inner flame ports 242 may generally correspond to a "circular inner burner ring" 202 of elongated burner assembly 200 that is operable to heat circular cookware, such as pots, pans, etc. Outer wall 244 extends around inner wall 240, and outer wall 244 may be spaced, e.g., radially, from inner wall 240. Outer wall 244 defines a plurality of outer flame ports 246. Thus, outer wall 244 and outer flame ports 246 may generally correspond to an "elongated outer burner ring" 204 of elongated burner assembly 200 that is operable to heat elongated cookware, such as griddles, fish poachers, etc. Inner flame ports 242 may be uniformly distributed on inner wall 240, and outer flame ports 246 may be uniformly distributed on outer wall 244.

As discussed above, inner wall 240 is circular while outer wall 244 is elongated, e.g., in a plane that is perpendicular to the vertical direction V. Thus, inner wall 240 and outer wall 244 have different shapes. The elongated shape of outer wall 244 may facilitate heating of elongated cookware. As an example, burner base 210 extends, e.g., along a transverse direction T that is perpendicular to the vertical direction V, between a first end portion 212 and a second end portion 214. Thus, first and second end portions 212, 214 of burner base 210 are spaced apart from each other, e.g., along the transverse direction T. A middle portion 216 of burner base 210 is positioned between first and second end portions 212, 214 of burner base 210, e.g., along the transverse direction T. Outer flame ports 246 on outer wall 244 at first and second end portions 212, 214 of burner base 210 may be positioned further from inner wall 240 than outer flame ports 246 on outer wall 244 at middle portion 216 of burner base 210. Thus, outer wall 244 may be elongated, e.g., along the transverse direction T, such that outer flame ports 246 are not uniformly spaced from inner wall 240. As a particular example, turning to FIG. 5, outer wall 244 may have a first portion 270 positioned remote from a center 274 of inner wall 240 and a second portion 272 positioned proximate center 274 of inner wall 240. First portion 270 of outer wall 244 may be positioned no less two inches (2") further from the center 274 of inner wall 240 than second portion 272 of outer wall 244.

Burner base 210 may also include a bottom wall or base plate 248. Inner wall 240 and outer wall 244 extend, e.g., upwardly along the vertical direction V, from base plate 248. As an example, base plate 248 may be integrally formed with inner wall 240 and/or outer wall 244. Thus, base plate 248, inner wall 240 and/or outer wall 244 may be formed from a single piece of cast metal, such as cast iron or aluminum.

Burner base 210 may further include an intermediate wall 250. Intermediate wall 250 extends from base plate 248, e.g., upwardly along the vertical direction V to cap 220. In addition, intermediate wall 250 may also be positioned, e.g., radially, between inner wall 240 and outer wall 244. Intermediate wall 248 assists with dividing fuel chambers for inner flame ports 242 and outer flame ports 246, as discussed in greater detail below. Intermediate wall 250 may be integrally formed with inner wall 240, outer wall 244 and/or base plate 248.

Cap 220 is positioned on burner base 210, e.g., inner wall 240 and outer wall 244. Cap 220 may be positioned on inner wall 240 over inner flame ports 242 and on outer wall 244 over outer flame ports 246. Thus, cap 220 may cooperate with burner base 210 to form fuel chambers within burner base 210. In particular, cap 220 may form a top wall of an inner fuel chamber 252 and an outer fuel chamber 254. For inner fuel chamber 252, inner wall 240 and intermediate wall 250 may form side walls of inner fuel chamber 252 while base plate 248 forms a bottom wall of inner fuel chamber 252. For outer fuel chamber 254, outer wall 244 and intermediate wall 250 may form side walls of outer fuel chamber 254 while base plate 248 forms a bottom wall of outer fuel chamber 254. Thus, intermediate wall 250 is positioned between and separates inner fuel chamber 252 and outer fuel chamber 254 within burner base 210.

As discussed above, cap 220 is positioned on inner wall 240 and outer wall 244. Thus, burner assembly 200 may have as single cap 220 positioned on both of inner wall 240 and outer wall 244, and cap 220 may be positioned over flame ports of multiple burner rings, e.g., circular inner burner ring 202 and elongated outer burner ring 204 of elongated burner assembly 200. In particular, cap 220 may define a circular opening 224 over or at inner wall 240, and cap 220 may have an outer edge 226 positioned over or at outer wall 244. A flat top surface 222 of cap 220 may extend between and connect opening 224 and outer edge 226 of cap 220. Thus, cap 220 may have a single flat top surface 222 over both inner wall 240 and outer wall 244. A single cap 220 may be easier to clean and/or manufacture relative to known burner assemblies with multiple caps.

Burner assembly 200 also includes a plurality of fuel inlets 260. As an example, burner base 210 may define at least one respective fuel inlet 260 at each of inner fuel chamber 252 and outer fuel chamber 254. Gaseous fuel, such as natural gas or propane, may flow into inner fuel chamber 252 and outer fuel chamber 254 via or through the respective one of fuel inlets 260. Thus, inner fuel chamber 252 and outer fuel chamber 254 are positioned and disposed for receiving the gaseous fuel from the respective one of fuel inlets 260. Fuel inlets 260 may be in fluid communication with fuel manifold 230 and received gaseous fuel from fuel manifold 230. For example, outlets 232 of fuel manifold 230 may extend upwardly from fuel manifold 230 to fuel inlets 260. As shown in FIG. 6, outlets 232 of fuel manifold 230 may extend past top panel 142 such that outlets 232 of fuel manifold 230 are positioned above top panel 142 along the vertical direction V.

Inner fuel chamber 252 is contiguous with inner flame ports 242 such that fuel is flowable out of inner fuel chamber 252 via inner flame ports 242. Inner flame ports 242 may extend radially inward from inner fuel chamber 252 on inner wall 240. Thus, circular inner burner ring 202 may be inwardly firing. Fuel exiting inner fuel chamber 252 at inner flame ports 242 is combustible during operation of the circular inner burner ring 202 of elongated burner assembly 200. Conversely, outer fuel chamber 254 is contiguous with outer flame ports 246 such that fuel is flowable out of outer fuel chamber 254 via outer flame ports 246. Outer flame ports 246 may extend radially outward from outer fuel chamber 254 on outer wall 242. Thus, elongated outer burner ring 204 may be outwardly firing. Fuel exiting outer fuel chamber 254 at outer flame ports 246 is combustible during operation of the elongated outer burner ring 204 of elongated burner assembly 200. It will be understood that inner flame ports 242 may be angled or oriented offset from the center 274 of inner wall 240 such that fuel exiting inner flame ports 242 swirls about the center 274 of inner wall 240.

Burner assembly 200 further includes at least one support 280. Supports 280 extend downwardly from base plate 248. Supports 280 are positionable on top panel 142 so that base plate 248 is spaced, e.g., along the vertical direction V, from top panel 142 and air is flowable between top panel 142 and base plate 248 to inner flame ports 242 and the circular inner burner ring 202 of elongated burner assembly 200 when burner base 210 rests on top panel 142. Thus, supports 280 may form an air flow channel between top panel 142 and base plate 248 that provides secondary air to facilitate fuel combustion at inner flame ports 242. Supports 280 may be posts, legs, flanges or any other suitable spacer. In addition, supports 280 may be integrally formed with inner wall 240, outer wall 244 and/or base plate 248.

The circular inner burner ring 202 of elongated burner assembly 200 and the elongated outer burner ring 204 of elongated burner assembly 200 are operable independently of one another. Thus, circular inner burner ring 202 of elongated burner assembly 200 may operate simultaneously with or separately from the elongated outer burner ring 204, as discussed in greater detail below.

FIGS. 7, 8, 9 and 10 provide top plan views of the elongated burner assembly 200 in various operating conditions. Elongated burner assembly 200 may be shifted between the various operating conditions shown in FIGS. 7, 8, 9 and 10 by rotating one of knobs 156. Thus, both the circular inner burner ring 202 and the elongated outer burner ring 204 of elongated burner assembly 200 may be operable with a single one of knobs 156. In particular, a user may rotate the one of knobs 156 to a first position to adjust elongated burner assembly 200 to the operating condition shown in FIG. 7 where fuel flows to inner flame ports 242 at a high rate (i.e., circular inner burner ring high setting). The user may then rotate the one of knobs 156 to a second position to adjust elongated burner assembly 200 to the operating condition shown in FIG. 8 where fuel flows to inner flame ports 242 at a low rate (i.e., circular inner burner ring low setting). The operating conditions shown in FIGS. 7 and 8 may be suitable for heating circular cookware on the circular inner burner ring 202 of elongated burner assembly 200.

Figure 9:
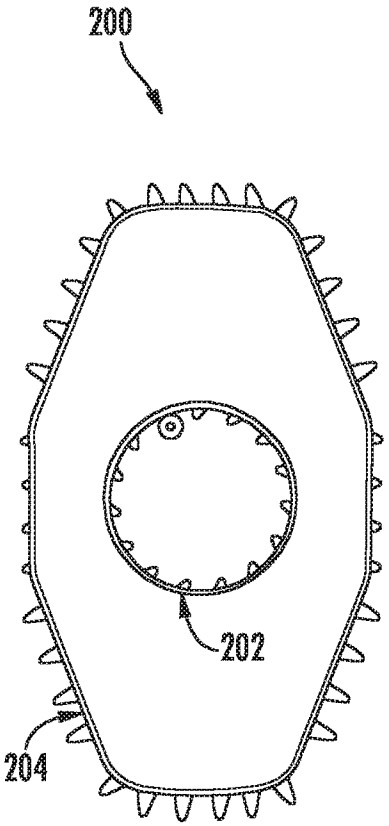
Figure 8:
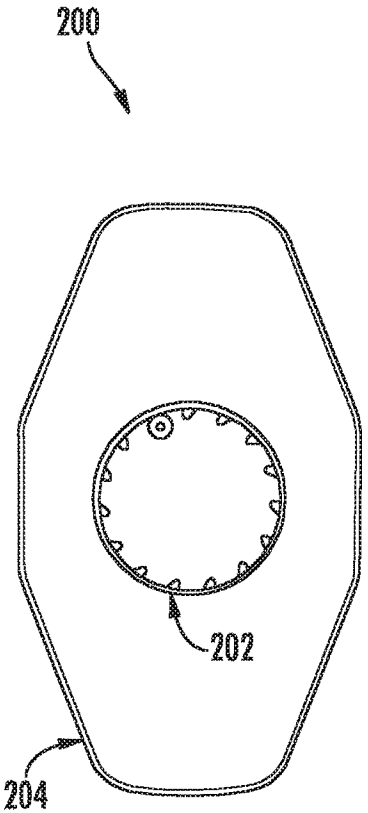
Figure 7:
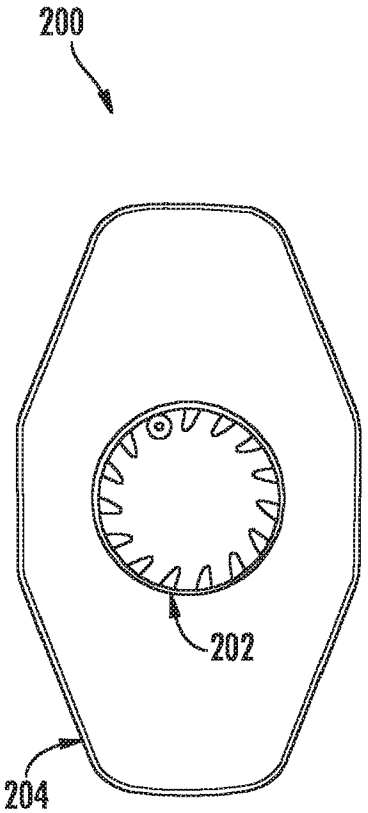

To heat elongated cookware, the user may rotate the one of knobs 156 to a third position to adjust elongated burner assembly 200 to the operating condition shown in FIG. 9 where fuel flows to inner flame ports 242 at a low rate and to outer flame ports 244 at a high rate (i.e., elongated outer burner ring high setting). The user may then rotate the one of knobs 156 to a fourth position to adjust elongated burner assembly 200 to the operating condition shown in FIG. 10 where fuel flows to inner flame ports 242 at a low rate and to outer flame ports 244 at a low rate (i.e., elongated outer burner ring low setting). The operating conditions shown in FIGS. 9 and 10 may be suitable for heating elongated cookware on the circular inner burner ring 202 and the elongated outer burner ring 204 of elongated burner assembly 200. The heat output of inner flame ports 242 may be constant during heating of elongated cookware to avoid overheating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for an appliance, comprising:

a circular inner wall defining a plurality of inner flame ports;

an elongated outer wall extending around the circular inner wall such that the elongated outer wall is spaced from the circular inner wall, the elongated outer wall defining a plurality of outer flame ports; a bottom wall, wherein the circular inner wall and the elongated outer wall are mounted to the bottom wall such that the circular inner wall and the elongated outer wall extend upwardly from the bottom wall; and a cap positioned on the circular inner wall over the plurality of inner flame ports and on the elongated outer wall over the plurality of outer flame port;

wherein the circular inner wall, the elongated outer wall and the bottom wall are integrally formed from a single piece of metal.

2. The gas burner assembly of claim 1, further comprising at least one support extending downwardly from the bottom wall, the at least one support positionable on an appliance top panel so that the bottom wall is spaced from the appliance top panel and air is flowable between the appliance top panel and the bottom wall to the plurality of inner flame ports.

3. The gas burner assembly of claim 1, wherein the inner flame ports are oriented offset from a center of the circular inner wall such that fuel exiting the inner flame ports swirls about the center of the circular inner wall.

4. The gas burner assembly of claim 1, wherein the elongated outer wall has a first portion and a second portion, the first portion of the elongated outer wall positioned no less two inches further from a center of the circular inner wall than the second portion of the elongated outer wall.

5. The gas burner assembly of claim 1, further comprising an intermediate wall positioned between the circular inner wall and the elongated outer wall, the intermediate wall positioned between an inner fuel chamber from an outer fuel chamber such that the inner fuel chamber is separate from the outer fuel chamber, the outer flame ports contiguous with the outer fuel chamber, the inner flame ports contiguous with the inner fuel chamber.

6. The gas burner assembly of claim 5, further comprising a bottom wall and at least one support, wherein the circular inner wall, the elongated outer wall and the intermediate wall are integrally formed with the bottom wall such that the circular inner wall, the elongated outer wall and the intermediate wall extend upwardly from the bottom wall, the at least one support extending downwardly from the bottom wall, the at least one support positionable on an appliance top panel so that the bottom wall is spaced from the appliance top panel and air is flowable between the appliance top panel and the bottom wall to the plurality of inner flame ports.

7. The gas burner assembly of claim 1, wherein the cap defines a flat top surface that extends over the circular inner wall and the elongated outer wall, the cap also defining a circular opening that is positioned proximate the inner flame ports.

8. The gas burner assembly of claim 1, wherein the circular inner wall is circular and the elongated outer wall is non-circular in a plane that is perpendicular to a vertical direction.

9. An appliance, comprising:

a top panel;

a gas burner assembly positioned at the top panel, the gas burner assembly comprising a circular inner wall defining a plurality of inner flame ports;

an elongated outer wall extending around the circular inner wall such that the elongated outer wall is spaced from the circular inner wall, the elongated outer wall defining a plurality of outer flame ports;

a bottom wall, the circular inner wall and the elongated outer wall mounted to the bottom wall such that the circular inner wall and the elongated outer wall extend upwardly from the bottom wall; and a cap positioned on the circular inner wall over the plurality of inner flame ports and on the elongated outer wall over the plurality of outer flame ports;

wherein the circular inner wall, the elongated outer wall and the bottom wall are integrally formed from a single piece of metal.

10. The appliance of claim 9, wherein the gas burner assembly further comprises at least one support extending downwardly from the bottom wall, the at least one support positioned the top panel so that the bottom wall is spaced from the top panel and air is flowable between the top panel and the bottom wall to the plurality of inner flame ports.

11. The appliance of claim 9, wherein the inner flame ports are oriented offset from a center of the circular inner wall such that fuel exiting the inner flame ports swirls about the center of the circular inner wall.

12. The appliance of claim 9, wherein the elongated outer wall has a first portion and a second portion, the first portion of the elongated outer wall positioned no less two inches further from a center of the circular inner wall than the second portion of the elongated outer wall.

13. The appliance of claim 9, wherein the gas burner assembly further comprises an intermediate wall positioned between the circular inner wall and the elongated outer wall, the intermediate wall positioned between an inner fuel chamber from an outer fuel chamber such that the inner fuel chamber is separate from the outer fuel chamber, the outer flame ports contiguous with the outer fuel chamber, the inner flame ports contiguous with the inner fuel chamber.

14. The appliance of claim 13, wherein the gas burner assembly further comprises a bottom wall and at least one support, the circular inner wall, the elongated outer wall and the intermediate wall integrally formed with the bottom wall such that the circular inner wall, the elongated outer wall and the intermediate wall extend upwardly from the bottom wall, the at least one support extending downwardly from the bottom wall, the at least one support positioned on the top panel so that the bottom wall is spaced from the top panel and air is flowable between the top panel and the bottom wall to the plurality of inner flame ports.

15. The appliance of claim 9, wherein the cap defines a flat top surface that extends over the circular inner wall and the elongated outer wall, the cap also defining a circular opening that is positioned proximate the inner flame ports.

16. The appliance of claim 9, wherein the circular inner wall is circular and the elongated outer wall is non-circular in a plane that is perpendicular to a vertical direction.

* * * * *